United States Patent [19]

Wormmeester et al.

[11] 4,253,803

[45] Mar. 3, 1981

[54] ROTARY POSITIVE DISPLACEMENT PUMP, ESPECIALLY GEAR PUMP

[75] Inventors: Johan G. Wormmeester, Rijswijk; Gyula I. Baranyai, Voorschoten, both of Netherlands

[73] Assignee: Fuelmaster Produktie Maatschappij B.V., Rijswijk, Netherlands

[21] Appl. No.: 4,839

[22] Filed: Jan. 19, 1979

[30] Foreign Application Priority Data

Feb. 7, 1978 [NL] Netherlands ..... 7801373

[51] Int. Cl.[3] ..... F04B 49/02

[52] U.S. Cl. ..... 417/283; 417/304; 417/310

[58] Field of Search ..... 417/283, 310, 304, 303; 418/15, 171

[56] References Cited

U.S. PATENT DOCUMENTS

| | | | |
|---|---|---|---|
| 2,380,783 | 7/1945 | Painter | 417/310 |
| 2,977,886 | 4/1961 | Banker | 417/283 |
| 3,137,234 | 6/1964 | Mosbacher | 418/171 |
| 3,655,299 | 4/1972 | Connelly | 417/310 |
| 3,806,283 | 4/1974 | Leverett | 417/283 X |
| 3,870,437 | 3/1975 | Gondek | 417/310 |

FOREIGN PATENT DOCUMENTS

| | | | |
|---|---|---|---|
| 2819718 | 11/1978 | Fed. Rep. of Germany | 417/310 |

*Primary Examiner*—Richard E. Gluck
*Attorney, Agent, or Firm*—Bacon & Thomas

[57] ABSTRACT

Rotary displacement pump, of which the delivery pressure can be adjusted by modifying the losses in the gap between the lateral flank or flanks of one or more of the gear wheels and the house in which these gear wheels are enclosed, at the place of this gap also the mouth of a channel being present, which channel is or can be connected to a return line.

1 Claim, 1 Drawing Figure

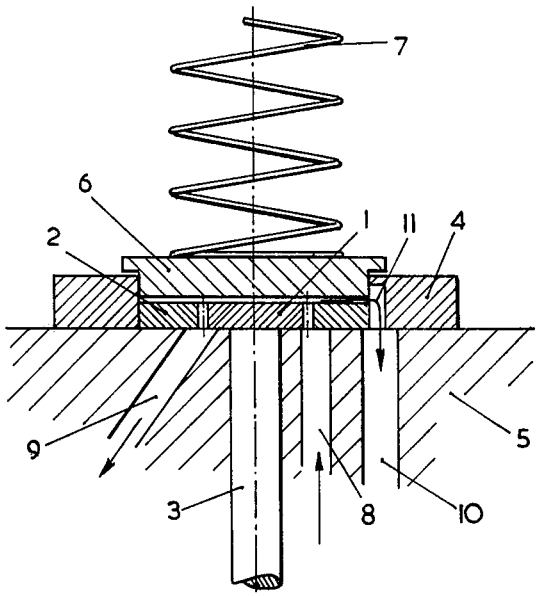
7
6
2
1
11
4
9
5
3
8
10

ROTARY POSITIVE DISPLACEMENT PUMP, ESPECIALLY GEAR PUMP

BACKGROUND OF THE INVENTION

This invention is in the field of positive displacement pumps.

It is known that the delivery pressure of a rotary pump, especially a gear pump, can be adjusted by modifying the gap losses between the lateral flank or flanks of one or more of the gear wheels and the housing in which these wheels are enclosed. This modification of the gap can be accomplished where one or more of the gear wheels and the wall of the housing opposite thereof can be displaced with respect to one another, the displaceable or mobile wall of the housing can respond to the pressure in the pump and be opposed by a resilient means. When a certain delivery pressure in the pump is exceeded, a gap occurs between the gear wheel or the gear wheels and the movable side of the housing, through which gap liquid can flow back from the pressure side to the suction side of the gear wheel or the gear wheels.

SUMMARY OF THE INVENTION

It is the purpose of the present invention to provide a pump, using the principle described above, which is connected to a so-called return line, through which line liquid is carried back from the pressure side of the pump to the storage tank when the desired delivery pressure is exceeded.

In the usual arrangement of this so-called two-pipe system, a separate pressure adjusting or overflow valve is present between the delivery side or delivery line and the return line.

According to the invention, a pump as described above has, at the place where the gap between the gear wheel(s) and the housing wall is formed, there is an entry point to a channel which can be connected to the return line. When said gap occurs at a too high pump pressure, then that port is opened and, when the return line is connected thereto, liquid from the delivery side of the pump can flow through the return line. A separate pressure adjusting or overflow valve has thereby become superfluous.

One of the advantages of a return line is that when the intake rate of pumped liquid is considerably lower than the pump capacity, the same "superfluous" quantity of liquid does not keep "whirling" in the pump, which might lead to overheating of the liquid. A further advantage is that air or another gas that might be present in the liquid or the suction line, can be evacuated through the return line.

It is to be noted that with a pump carried out according to the present invention, a part of the "superfluous" liquid will flow directly to the suction side of the gear wheels when the delivery pressure is too high. Depending on the conditions, the part that will enter the return line, will amount to e.g. a quarter or one half of the excess liquid.

BRIEF DESCRIPTION OF THE DRAWING

As an example of a pump structure embodying the invention, the FIGURE schematically shows such a pump in section.

DESCRIPTION OF A PREFERRED EMBODIMENT

In the FIGURE, 1 indicates the innermost and 2 the outermost gear wheel of a set of co-operating gear wheels. The innermost wheel 1 is mounted on the drive shaft 3. The set of gear wheels is surrounded by the ring 2, which is part of or secured to the pump housing 5. The central opening of the ring 2 snugly and slidably receives a mobile wall part of a lid 6, urged inwardly by an adjustable compression spring 7. In the housing 5 are formed a supply channel or suction line 8 and an exhaust channel or delivery line 9, and adjacent the supply channel a channel 10 is formed. The channel 10 is connected to a groove 11 in the ring 2, which groove extends across the gear wheels to define an entry port.

When the pressure in the pump becomes higher than desirable, the lid 6 is lifted slightly, by that pressure, against the action of the spring 7 and a gap is formed between the lid 6 and the gears, shown exaggeratingly large in the drawing for the sake of clearness, through which gap liquid can flow away from the delivery side of the gear wheels both towards the suction side and towards the entry port, so that the delivery pressure may regulate itself in the desired way. As the lid 6 is lifted, the size of the entry port to the groove 11 increases.

The application of the invention is not restricted to the embodiment shown in the drawing. It should be noted in particular that the invention can be used with gear pumps with external teeth and in general with rotary positive displacement pumps (such as described, e.g., in U.S. Pat. Nos. 1,694,805 and 2,765,745), which in the scope of the present application can be considered as gear pumps.

It should also be noted that if one wishes to use the pump according to the present application in a system in which no return line is used, it is a simple matter to plug the channel 10. Thus the same pump can be used in systems with or without a return line, so that the pump possesses a wide field of application.

We claim:

1. In a positive displacement pump having a rotor in a housing having opposed side walls and a peripheral wall and wherein one side wall of said housing is resiliently urged against a side of said rotor by resilient means, said housing having an inlet region and an outlet region defined in part by said one side wall, the improvement comprising:

a passageway having an inlet end communicating with the interface between said rotor and said one side wall whereby when pressure in said outlet region exceeds an amount determined by said resilient means and moves said one side wall away from said rotor, fluid from said outlet region will flow to said passageway, said rotor being a gear rotor; an outer gear member surrounding said gear rotor and meshing therewith; the peripheral wall of said housing comprising a ring having an inner peripheral face surrounding said outer gear member, said one side wall being axially movable relative to said ring; said passageway comprising a channel extending axially across the inner face of said ring and communicating with passage means leading to the exterior of said housing.

* * * * *